United States Patent [19]

Fleishman et al.

[11] Patent Number: 4,665,833

[45] Date of Patent: May 19, 1987

[54] MINIATURE ELECTRIC TRACK AND TRAIN

[76] Inventors: Herman B. Fleishman, Maplewood, N.J.; Janis L. Fleishman, administratrix, 51 S. Pierson Rd., Maplewood, N.J. 07040; David B. Lightbody, 31 Margie Ave., Cresskill, N.J. 07626

[21] Appl. No.: 301,232

[22] Filed: Sep. 11, 1981

Related U.S. Application Data

[63] Continuation of Ser. No. 738,431, Nov. 3, 1976, abandoned.

[51] Int. Cl.[4] ..... B60L 15/32

[52] U.S. Cl. ..... 104/301; 104/295; 104/DIG. 1; 238/122; 295/1

[58] Field of Search ..... 104/1 R, 1 A, 60, DIG. 1, 104/295, 296, 301; 238/10 R, 10 A, 10 B, 10 C, 10 E, 122; 191/3, 5, 12 R, 22 DM, 29 DM, 56, 57, 58, 63; 295/1, 7, 8, 9 R, 9 A, 11, 33; 46/216, 217, 257, 260; 246/246, 255; 29/123, 125; 318/53, 59; 200/277

[56] References Cited

U.S. PATENT DOCUMENTS

| | | | |
|---|---|---|---|
| 1,813,560 | 7/1931 | Browne et al. | 104/301 X |
| 2,462,073 | 2/1949 | Daughton | 238/10 E X |
| 2,708,885 | 5/1955 | Smith | 104/296 |
| 2,872,879 | 2/1959 | Vierling | 104/301 |

FOREIGN PATENT DOCUMENTS

| | | | |
|---|---|---|---|
| 826719 | 1/1952 | Fed. Rep. of Germany | 46/216 |
| 453339 | 11/1949 | Italy | 104/DIG. 1 |
| 629572 | 9/1949 | United Kingdom | 238/10 R |

*Primary Examiner*—Randolph A. Reese

[57] ABSTRACT

A miniature electric track and train system which provides a simple and inexpensive arrangement for the simultaneous independent operation of at least two electric engines on the same track.

2 Claims, 6 Drawing Figures

Fig. 1.
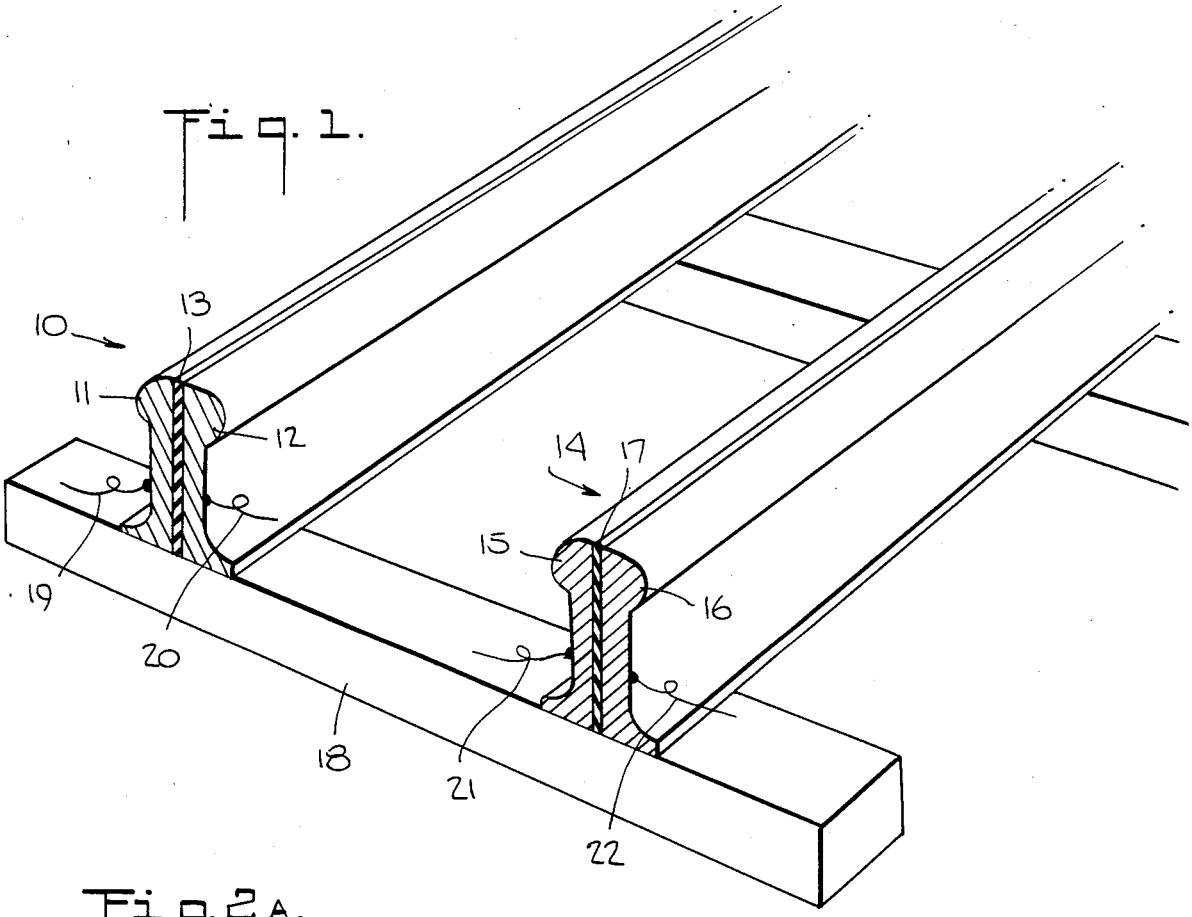
Fig. 2A.
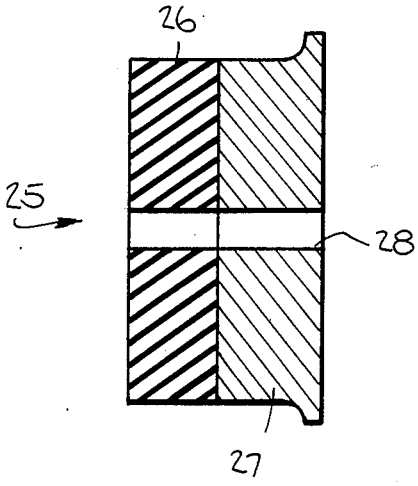
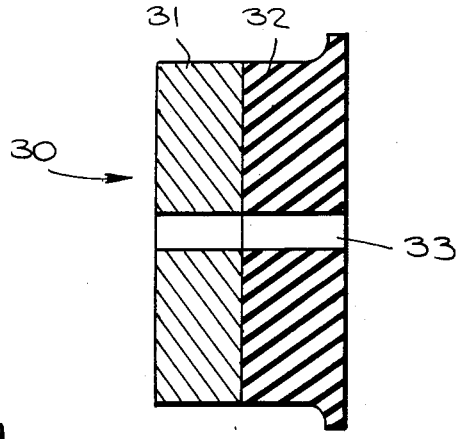
Fig. 2B.
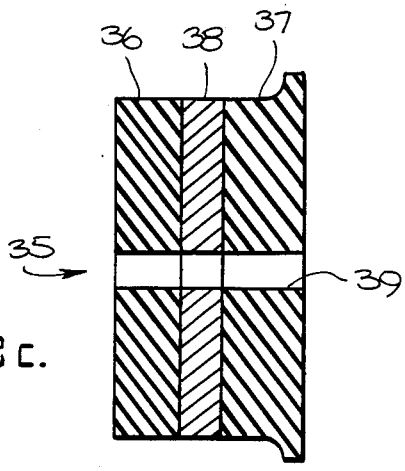
Fig 2C.

MINIATURE ELECTRIC TRACK AND TRAIN

This is a continuation of application Ser. No. 738,432 filed Nov. 3, 1976 now abandoned.

BACKGROUND OF THE INVENTION

Although toy or miniature electric trains exists as early as 1850 and they have been highly popular since the early 1900's, the operation of most miniature electric trains has remained essentially unchanged. Except for exceedingly technical, sophisticated and expensive systems, more than one engine could not be operated independently and simultaneously on the same section or block of trackage. The basic miniature electric train "system", as a minimum, consists of the following components:

(1) A locomotive or engine which contains an electric motor which operates on either direct or alternating current (DC or AC), flanged wheels suitable for running on miniature track, at least two of which are electrically conducting and electrically isolated from each other for DC powered motors and at least one of which is electrically conducting and electrically isolated from a third isolated conductor, usually called a shoe, for AC powered motors, a gear train which connects the rotation of the motor to the wheels, thus moving the engine, and an electrical contact system which connects the two electrically conducting wheels to the two leads of the DC motor or connects at least one wheel and the shoe to the leads of the AC motor.

(2) A system of trackage consisting of two (for DC operation) or three (for AC operation) electrically conducting rails which are fixed to some form of track tie and/or road bed which electrically isolates two of the conducting rails from each other.

(3) An appropriate DC power supply whose two output leads are connected, one lead to each rail of the two rail track, or an appropriate AC power supply whose two output leads are connected, one to the center rail and the other to one of the outside rails of the three rail track.

In addition to the foregoing, the power supply, AC or DC, is usually equipped such that voltage to the track can be adjusted from zero to some maximum thus making the engine move faster or slower or stop. Some engines are equipped with miniature head lights whose brightness is proportional to the amount of power supplied to the track, since the headlight derives its power from the motor circuit.

An appealing feature of such miniature trains is that they duplicate or simulate both in appearance and operation the real, prototype railroads. For this reason, miniature electric trains are manufactured in a number of different scales. For example, in an "HO" scale engine a foot on the prototype engine is equal to 0.138 inches on the miniature of that prototype. Each "scale" has associated with it, its own track gauge. Gauge is the distance between the outermost and innermost rails of the track measured from the inside-to-inside of the rails. This, again, promotes prototypical appearance.

Toy or miniature electric trains usually include an oval of track, an appropriate electrical power supply, freight or passenger cars and one engine. This permits the trains to go around and around the track. To improve interest and enjoyment, the operator can add more track and another engine with more freight or passenger cars so that two separate trains can be independently operated at the same time, as in a prototypical railroad.

However, if two engines are placed on the same track oval, (assuming the power supply has the capacity to run both engines), both engines will move in the same way. Both will go forward, backward or stop at the same time and, given different engines with different loads, one will eventually overtake the other. This does not achieve the goal of prototypical operation, i.e., of having two engines independently operated on the same track at the same time.

Another alternative is to place a second engine on the track and connect a second power supply. This is no better than the first situation. The engines still do the same thing. Moreover, they can receive too much power, burning out their motors, or electrical shorts can occur between the power supplies, burning both the supplies and the motors out.

A third alternative is to electrically insulate one half of the oval of track from the other and connect separate power supplies to each half. This, too, does not achieve the goal of simultaneous, independent operation of two trains on the same section of track.

Still another attempt to solve the problem is called "cab control" or "block control". In "cab control" or "block control" systems, the power supply is connected to each separate insulated section or "block" of track as the train moves into that section, from section to section, while at the same time disconnecting any other power supply from the sections to be controlled. For even a modest size model railroad and two trains operating at the same time, literally hundreds of feet of complex wiring, soldering, switches and insulating procedures are required in addition to the construction of the structure and control panels necessary to mount all the electrical components of wires. In order for a train to proceed along the track from section to section the operator must constantly operate the switches which successively connect and disconnect his power source. More important, no two trains can occupy the same track section or block at the same time. The goal of prototypical operation is not achieved.

In recent years there have been still other attempts to achieve the goal of operating more than one train simultaneously on the same trackage. Such attempts have involved even more complications and expense. For example, a special power supply is arranged to provide a number of AC signals to the rails. As many as six different signals (frequencies or pulse codes) are generated. A special receiver tuned to one of the six signals is installed in an engine. The received AC signal is then converted to DC by a special rectifier component in the engine and then fed to the engine's DC motor. This system will and does operate trains independently on the same trackage but it is expensive, requires complex electronics, and must be installed by the buyer. Special service is required for repairs. One can only use receiver equipped trains. The receiver/rectifier components to be installed in the engines do not fit in all types of engines and each installation requires different installation techniques.

BRIEF DESCRIPTION OF THE PRESENT INVENTION

The present invention solves the problem of providing a simple and inexpensive system for the simultaneous, independent operation of at least two different engines on the same model railroad trackage to achieve true prototypical operation.

The present invention involves both novel track and novel engine wheels. In accordance with the present invention, the track is made up of at least two rails, each rail comprising at least two conductive rail elements separated by an insulator, thus providing at least three separate and independent electrical power and control circuits. Also in accordance with the present invention, the engine wheels have both conducting and insulating sections for making contact with various ones of the rail elements. In this way at least two engines may be simultaneously, independently operated on the same track section in true prototypical fashion.

BRIEF DESCRITPION OF THE DRAWINGS

The present invention will be described in greater detail in connection with the following drawings wherein:

FIG.1 is a view in section of a track in accordance with one embodiment of the present invention;

FIG. 2A is a view in section of one type of engine wheel in accordance with one embodiment of the present invention.

FIG. 2B is a view in section of a second type of engine wheel in accordance with one embodiment of the present invention;

FIG. 2C is a view in section of a third type of engine wheel in accordance with one embodiment of the present invention;

DETAILED DESCRIPTION

Figure 3:
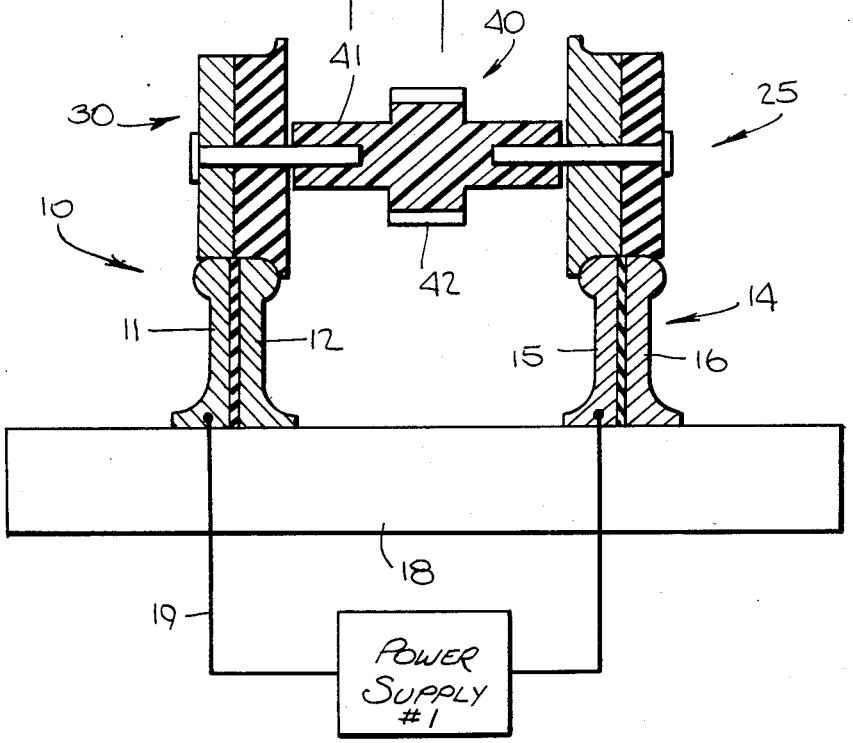
FIG. 3 is a view in section of a wheel set and track in accordance with one embodiment of the present invention.

Referring to FIG. 1, the novel track of one embodiment of the present invention is illustrated. It comprises a left rail 10 formed of conductive rail elements 11 and 12 with insulator 13 therebetween. The track also comprises a right rail 14 formed of conductive rail elements 15 and 16 with insulator 17 therebetween. Connecting rail elements 11, 12, 15 and 16 and insulated therefrom is cross member 18, which may be a tie and/or a roadbed. Connected to rail elements 11, 12, 15 and 16 respectively are conductive leads 19 through 22 which are adapted to be connected to a plurality of power supplies (not shown).

Rail elements 11, 12, 15 and 16 actually form six electrically separate sets of two rail tracks, i.e., sets 11-12, 11-15, 11-16, 12-15, 12-16 and 15-16. Thus, while in appearance the track has two rails and it occupies the space of what would be a single two rail track, electrically there are six different two rail tracks in the space occupied heretofore by one two rail track.

Referring now to FIG. 2A, there is shown engine wheel 25 of one embodiment of the present invention. It comprises insulating cylindrical portion 26, conducting flanged portion 27 and hollow, axial passage 28 for mounting wheel 25. In FIG. 2B is disclosed engine wheel 30 which comprises cylindrical conducting section 31, flanged insulating section 32 and hollow axial passage 33. When engine wheels 25 and 30 are viewed in light of track 10 it will be seen that wheel 25 can make electrical contact with rail elements 12 or 15 and wheel 30 can contact rail elements 11 or 16.

Referring now to FIG. 3, there is shown a wheel set 40 riding on rails 10 and 14 in accordance with this embodiment of the invention. Wheel set 40 comprises left wheel 30 and right wheel 25 connected by axle 41. Mounted on axle 41 is drive gear 42. Wheel set 40 contacts rail elements 11 and 15 which are connected to Power Supply #1 through leads 19 and 21. Thus, a first engine equipped with wheel set 40 could go anywhere on the railroad trackage independent of any other train using other rail element pairs.

Similarly, a second wheel set comprising left wheel 30 and right wheel 30 would contact rail elements 11 and 16 which may be connected to Power Supply #2 through leads 19 and 22. In this manner a second engine equipped with this second wheel set could be operated on the same track simultaneously and independently of the first engine. Finally, a third wheel set comprising left wheel 25 and right wheel 25 would contact rail elements 12 and 15 which may be connected to Power Supply 3 through leads 20 and 21. In this way a third engine equipped with this third wheel set could be operated on the same track independently of the first two engines.

Figure 4:
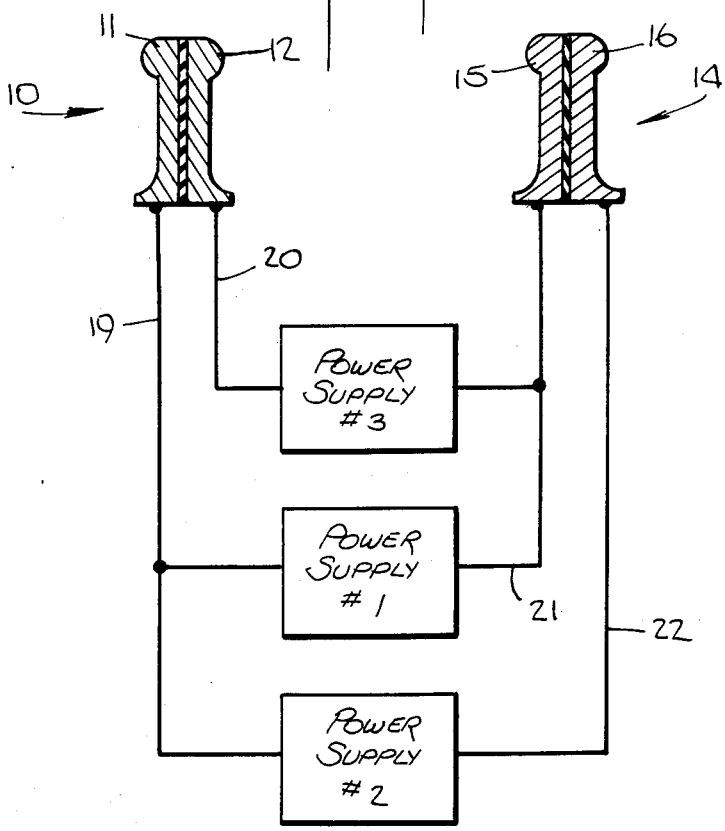
FIG. 4 is a schematic diagram illustrating how three power supplies may be connected to simultaneously, independently operate three engines on the same track in accordance with one embodiment of the present invention.

The foregoing embodiment is illustrated schematically in FIG. 4. Note that one could not connect a fourth power supply between leads 19 and 20 in this embodiment of the invention because to do so would connect Power Supply #1 with #3. Similarly, one could not connect a fourth power supply between leads 21 and 22 in this embodiment of the invention because that would connect Power Supply #1 with #2. Also, one could not connect a fourth power supply between leads 20 and 22 in this embodiment of the invention because that would connect Power Supply #3 with #2.

Thus, although in this embodiment of the invention there are six separate rail element pairs which may be formed using rail element 11, 12, 15 and 16, only three engines may be simultaneously, independently operated on the same track in true prototypical fashion. The particular rail pairs selected for use is a matter of individual choice, the pairs 11-15, 11-16, 12-15 and 12-16, however, being preferred over the pairs 11-12 and 15-16 for engine operation because of superior electrical contact.

The present invention has many advantages. It is simple and inexpensive. It is applicable to all scales and gauges. Engine manufacturers need only use the special engine wheels and supply the special track, both as disclosed herein. Nothing is required of the user except to connect his power supply just as he does today. No special electronics and no special servicing or repair facilities are required. The present invention does not interfere with the present means of producing engines. It does not occupy any additional space in the engine nor does it require the purchaser to install anything. The embodiment of the present invention illustrated and described above provides prototypical operation of any three of six trains simultaneously on the same trackage and yet is so simple that even children can assemble and operate the system.

The present invention operates using existing, standard power supplies. Moreover, a train not equipped with the special wheel sets disclosed herein can operate on the special track without damage. It would operate exactly as it does today, one engine at a time. Present engines not equipped with special wheel sets can easily be converted to the present invention since the changing of wheel sets is a simple, mechanical modification.

Another advantage of the present invention relates to auxiliary equipment operating off the track power, such as engine headlights and passenger car lights. At the present time such lights are extinguished when the train stops (not track power) or vary in brightness as power to the train is increased or decreased. While there are several electronic devices available commercially which can allow lights to glow steadily, independent of train motion, just as the "real" train lights do, such devices are expensive. The present invention can provide for constant lighting at no extra cost as follows.

In the embodiment of the invention illustrated and described above, there are three powered rail element pairs available for simultaneous use. Instead of operating three engines simultaneously, one may desire to operate only two engines and to employ the third powered rail element pair to operate lights, the power being supplied by a third power supply providing an adjustable voltage so that headlight and passenger car lights can glow at a selected brightness independent of the motion of the trains. This may be accomplished by connecting the light bulbs to the third wheel set on the cars or engines.

This same technique may also be used to operate other auxiliary equipment such as smoke machines in steam engines. Present day smoke machines stop operating when the train is stopped. Again, this is not prototypical. The third powered rail element pair may be used to operate still further auxiliary equipment so as to produce sound effects from speakers mounted in the engine or cars.

As mentioned earlier, there are two possible types of electrical power sources and engines motors, i.e., AC and DC. In prior art arrangements it does not appear possible to operate a DC motor on track using AC power (this could, in addition to not working, burn out the DC motor) and it does not appear possible to operate an AC motor on track using DC power. The prior art expensive electronic system operates only DC trains.

An AC motor, like a DC motor, requires two separate connections. In a typical commercial AC model train, for example, one connection is made via the middle, insulated rail and the other via one (or both) of the outer rails, which are uninsulated and electrically connected by cross members. With a suitable mechanical modification of the engine to permit power pick-up from the outside rails, it would be possible, in accordance with the present invention, to run one AC and two DC or two AC and one DC powered trains simultaneously and on the same prototypical appearing track. Not even the expensive electronic system permits such a result.

The invention disclosed and claimed herein is not limited to the specific mechanism and techniques herein shown and described since modifications will undoubtedly occur to those skilled in the art. For example, wheel 25 illustrated in FIG. 2A can be made tapered so that electrical contact is made by the flange 27 only with rail elements 12 or 14. Because of the taper, cylindrical portion 26 does not contact rail elements 11 or 16. In this embodiment, cylindrical portion 26 need not be made of insulating material because it does not contact rail elements 11 or 16. In other words, cylindrical portion 26 is insulated from rail elements 11 and 16 by the air. Accordingly, this embodiment is functionally identical with wheel 25.

In another embodiment of the present invention each rail of the track may consist of three conductive rail elements separated by insulators to provide at least five separate and independent power and control circuits. In this embodiment the engine wheels would have conducting and insulating sections for making contact with appropriate pairs of rail elements. One such wheel, wheel 35, is illustrated in FIG. 2C. It comprises a flanged insulating section 37, an outer cylindrical insulating section 36 a cylindrical conducting section 38 therebetween, and an axial passage 39 for mounting wheel 35. Other departures may be made from the form of the instant invention without departing from the principles thereof.

What we claim is:

1. A miniature electrical track and train system for independently operating three miniature electric train engines simultaneously on the same track using three separate power supplies, said system comprising:

(a) a pair of substantially equidistant, prototypically appearing electrically energizable running rails, each rail having a substantially flat, continuous railhead, each rail being divided into two rail elements, each rail element being electrically insulated from the other;

(b) a first engine electrical contact wheel set adapted for mounting on a first engine for supplying electrical power derived from said running rails to said engine, said first wheel set comprising two prototypically appearing wheels, each of said wheels consisting of a conducting flange and a cylindrical boss segregated into two annular portions, a first, conducting portion contiguous said flange and a second, insulating portion contiguous said first portion;

(c) a second engine electrical contact wheel set adapted for mounting on a second engine for supplying electrical power derived from said running rails to said engine, said second wheel set comprising two prototypically appearing wheels, each of said wheels consisting of an insulating flange and a cylindrical boss segregated into two annular portions, a first, insulating portion contiguous said flange and a second, conducting portion contiguous said first portion;

(d) a third engine electrical contact wheel set adapted for mounting on a third engine for supplying electrical power derived from said running rails to said engine, said third wheel set comprising two prototypically appearing wheels, one of said wheels consisting of an insulating flange and a cylindrical boss segregated into two annular portions, a first, insulating portion contiguous said flange and a second, conducting portion contiguous said first portion, the other of said wheels consisting of a conducting flange and a cylindrical boss segregated into two annular portions, a first, conducting portion contiguous said flange and a second, insulating portion contiguous said first portion; and (e) said four rail elements being adapted for connection to three power supplies to form three independent electrical power and control circuits, one for each of said engines.

2. A system according to claim 1 wherein said annular portions are approximately equal.

* * * * *